175-40 SR
6/14/83 OR 4,387,774

United States Patent [19]
Herbert

[11] 4,387,774
[45] Jun. 14, 1983

[54] TIME RECORDER FOR IN-HOLE MOTORS

[75] Inventor: Roger P. Herbert, Lake Forest, Calif.

[73] Assignee: Smith International, Inc., Newport Beach, Calif.

[21] Appl. No.: 260,269

[22] Filed: May 4, 1981

[51] Int. Cl.[3] ..... E21B 45/00
[52] U.S. Cl. ..... 175/40; 73/151; 346/33 WL
[58] Field of Search ..... 73/151, 151.5; 175/40, 175/48, 26, 107; 346/33 WL; 166/64; 415/502, 51

[56] References Cited

U.S. PATENT DOCUMENTS

| | | | |
|---|---|---|---|
| 2,958,821 | 11/1960 | Webb | 175/40 X |
| 3,588,908 | 6/1971 | Lindsey | 346/33 |
| 3,788,136 | 1/1974 | Park | 73/151 |
| 3,908,453 | 9/1975 | Jeter | 73/151 |

FOREIGN PATENT DOCUMENTS

| | | | |
|---|---|---|---|
| 1021408 | 12/1977 | Canada | 166/64 |
| 1538579 | 1/1979 | United Kingdom | 175/48 |
| 679830 | 8/1979 | U.S.S.R. | 73/151 |

*Primary Examiner*—Ernest R. Purser
*Assistant Examiner*—Michael J. Starinsky
*Attorney, Agent, or Firm*—Philip Subkow

[57] ABSTRACT

Real time responsive devices are mounted at the inlet to an in-hole motor to measure the interval of time during which drilling fluid circulates through the motor.

12 Claims, 6 Drawing Figures

TIME RECORDER FOR IN-HOLE MOTORS

STATEMENT OF THE INVENTION

This invention relates to in-hole drilling motors including progressive cavity motors such as is shown in U.S. Pat. No. 3,989,114, incorporated herein by this reference, or turbine or electric in-hole motors with means for determining the period of time during which the motor is operated in its drilling mode, and if desired, also the period of time that circulation of drilling fluid is in the non-drilling mode.

The aforesaid means takes advantage of the difference in pressure across the motor and drill bit assembly present during the drilling mode and during operations in the non-drilling mode.

A pressure device is provided. The device responds to levels of pressure differences occuring in the motor drill assembly to determine the time intervals during which the motor is operating in the drilling mode and, if desired in the non-drilling mode.

This information is of importance in determining the performance of the motor and duration of operation in said modes.

Means are provided mounted in association with the motor which records the interval of time during which the pressure drop across the motor and the bit occurs in the drilling mode. If desired means may also be provided which measures the period of time during which the pressure drop across the motor and bit to that which is present when the motor and bit are in the non-drilling mode.

The means employed in the preferred embodiment, is operative responsive to the difference in pressure between the pressure in the pipe section at the entrance to the stator of the motor and the pressure in the bore hole substantially adjacent to the stator during drilling.

Means are provided to record a signal during the period of time that a pressure difference is established by the circulation of fluid during the period that the said bit is in drilling operation.

Means may also be provided to record a signal during the period of time during which fluid is circulated through the motor when the bit is in the non-drilling condition.

In the preferred embodiment of my invention, described herein, time responsive device are provided to generate a signal when the pressure drop from a point up stream of the stator and the discharge from the bit in the drilling mode.

A time responsive device may also be provided to generate a signal when the pressure drop from a point up stream of the stator to the discharge from the bit in the non-drilling mode.

The time responsive device is associated with a source of power and a pressure drop responsive switch which closes the current between the power source and the time responsive device when the pressure drop is in the drilling mode.

An additional like time responsive device may be provided which closes a current between a power source and a time responsive device when the power drop is in the non-drilling mode.

The time responsive device includes means to generate a signal whose magnitude is responsive to the period of real time during which the pressure drop of the fluid passing to the entrance to the stator of the motor and the discharge of the fluid from the bit.

In the preferred embodiment the power source is connected to the time responsive device by a pressure differential switch which is responsive to the pressure in the interior of the pipe section at the entrance to the stator and the pressure at the exterior of the pipe section at substantially the said location.

The time responsive device may be a clock which generates a signal whose magnitude is responsive to the interval of time that said switch has connected the time responsive device to the power source.

I prefer however, to use a time responsive device which generates a voltage whose magnitude is responsive to the pressure difference exerted between the pressure in the pipe section at the entrance to the stator and the exterior of the pipe section at substantially the same location.

Means may be provided which may be located at any desired location which will translate the said signal to the real time during which the said signal is generated.

This invention is further described by reference to the drawings of which:

FIG. 1 illustrates the conditions when the drill is in the drilling mode with the by-pass valve, if used in closed condition. The hydraulic pressure drop across the switch is the differential established by the pressure drop across the stator of the motor and the pressure drop between the discharge from the stator and across the bit nozzles.

For example in a motor of the progressive cavity type, such as in the above Tschirky U.S. Pat. No. 3,989,114, when in the drilling mode, the pressure differential across the stator of the motor may be of the order of about 350–500 psi and a useful value for the pressure drop across the nozzles may be of the order of about 200–1000 psi. The pressure drop across the switch in such case would be above about 500–600 pounds. These values are merely illustrative and will vary from case to case.

In the non-drilling mode, where no by-pass valve is used, the pressure drop across the stator is substantially less than in the drilling mode. In the case a by-pass valve is used, the pressure drop across the switch is substantially insignificant and determined by the pressure drop across the by-pass valve.

I therefor provide pressure responsive switches operative at the above pressure differentials to actuate the clock mechanisms to measure the time intervals during which the above pressure differentials are established across the switch, and thereby obtain a record of the time during which the motor is operating in its various operating modes.

Figure 1:
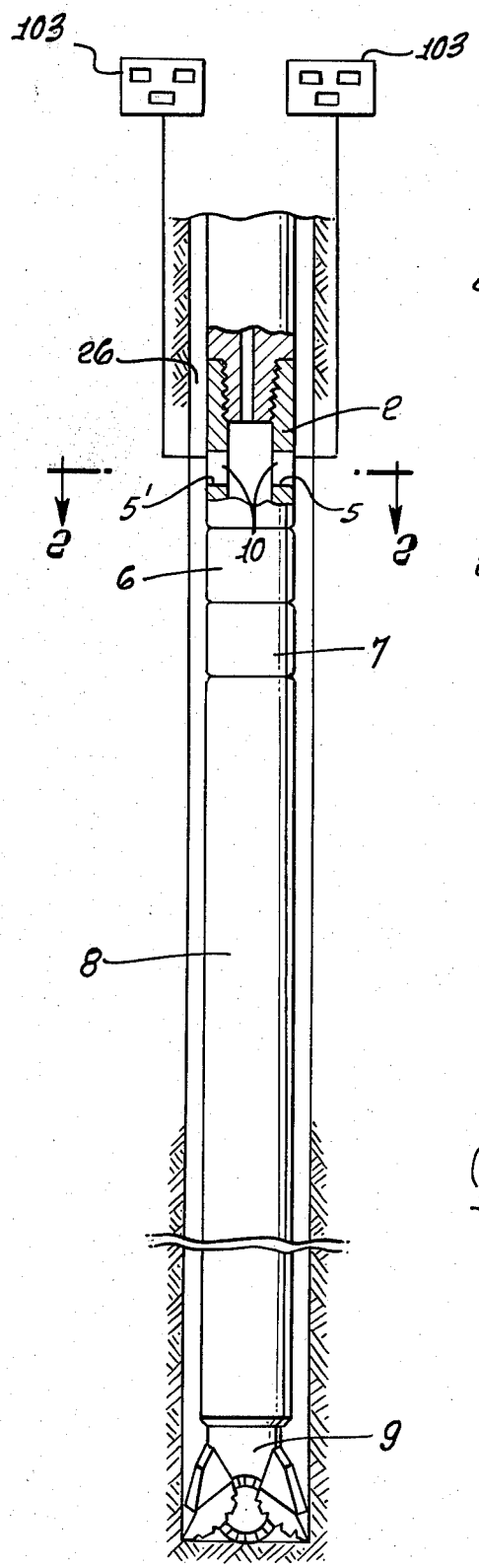
FIG. 1 is a schematic showing of a time recorder positioned with an in-hole motor drilling assembly.

FIG. 1 shows, schematically, an assembly of an in-hole motor positioned in a drill string. The drill string which is composed of drill pipe assembled and positioned in a bore hole drilling string, as is conventional, is connected by the usual pin and box connections through a dump valve 6 and a circulating valve 7 (see for example, U.S. Pat. No. 3,989,114), if used, to the in-hole motor 8 which is connected in the usual fashion to a drill provided as is usual with circulating nozzles. If the circulating valve can act as a dump valve, the circulating valve may be omitted. While both a dump valve or a circulating valve, as is desired, are commonly used, they are not a necessary part of my invention.

In order to provide for the time recorder of my invention, I arrange a space in a pipe section up stream from the motor, to hold the time recorder.

Figure 4:
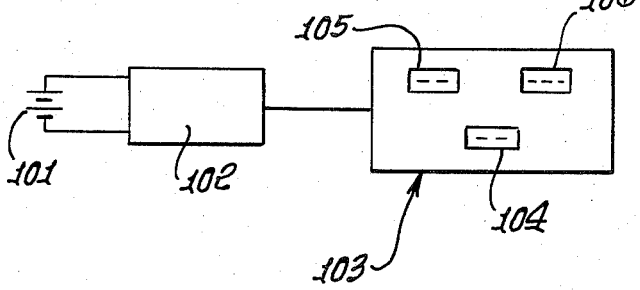
FIG. 4 is a schematic block diagram of one form of a real time recorder positioned above adjacent the entrance to the stator of the in-hole motor.

Referring to FIGS. 1 and 4, positioned in cavity 5 is a pressure sensitive switch shown schematically in FIG. 4 at 102 which when subjected to a predetermined pressure differential across the switch closes the circuit to activate a clock mechanism which is responsive to the real time during which the pressure differential is established across the switch. Clocks which are energized by battery power and display the period of time during which they are so energized by battery power and display the duration of such time in minutes, hours, days are well known and in common use.

Thus in FIG. 4, the battery 101, switch 102 and clock 103 may be positioned in the cavity 5 or 5' in the pipe section 2 shown in FIG. 1.

Figure 3:
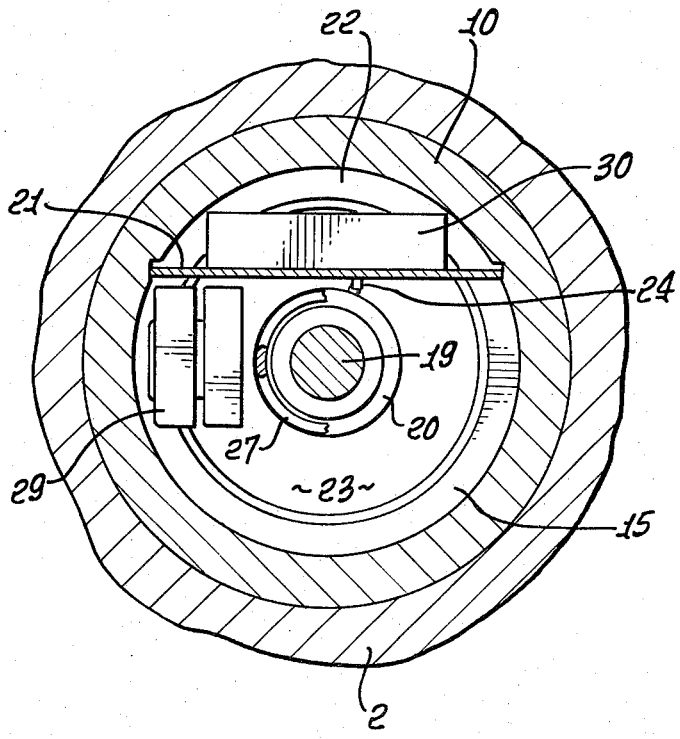
FIG. 3 is a section taken on line 3—3 of FIG. 2.
Figure 2:
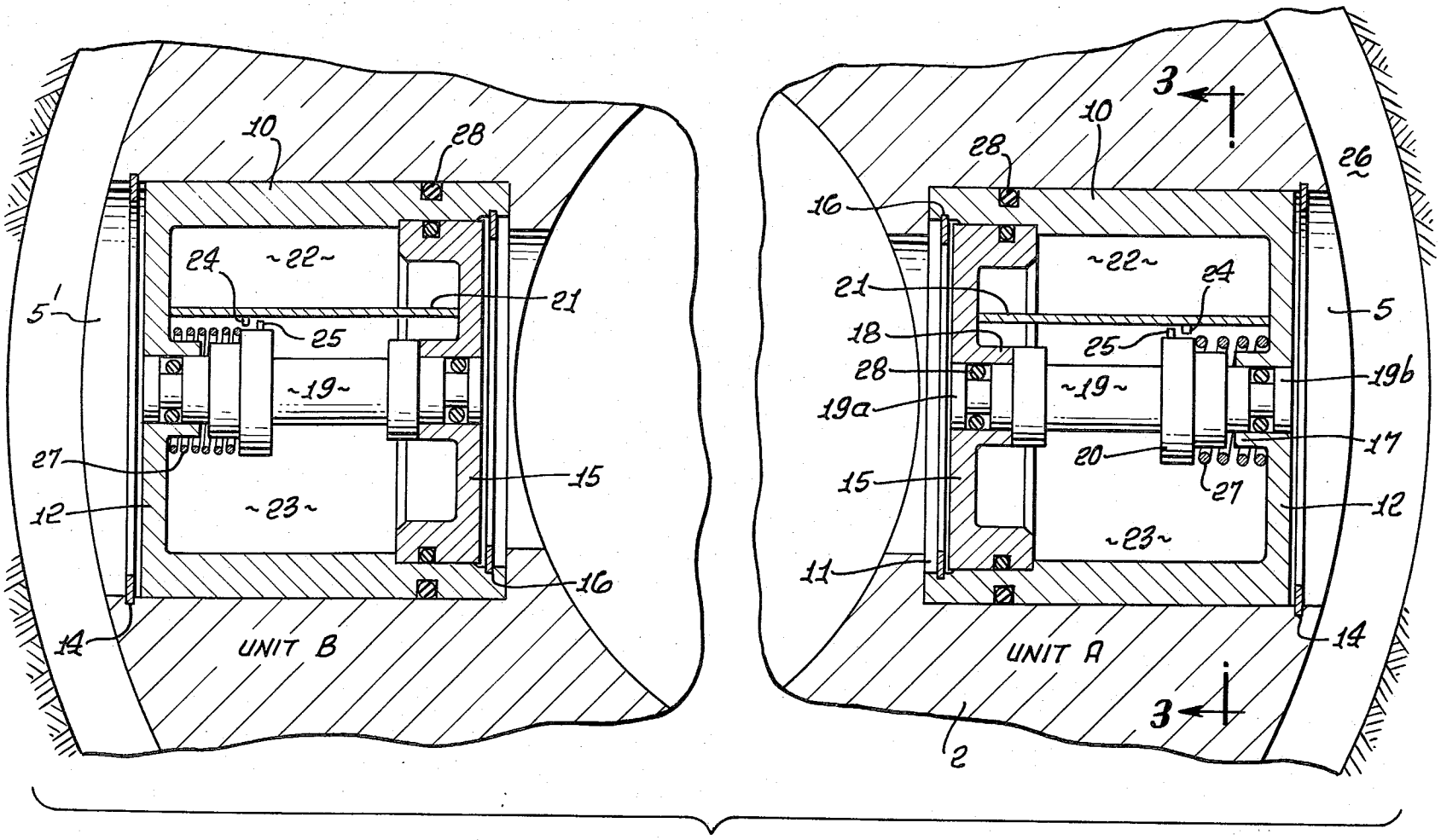
FIG. 2 is a fragmentary section taken on line 2—2 of FIG. 1.

FIGS. 2 and 3 illustrate a preferred embodiment of the switch associated with the recorder of the real time during which the selected pressure differential is exerted in the drilling system, showing the positioning of the switch in a self contained transducer mounted, for example, in the cavity 5 (see FIGS. 1–3), or in any other manner up stream from the stator of the motor 8.

The cup shaped housing 10 of Unit A (see FIG. 2) is secured in the cavity 5 by snap ring 14. The open end 11 of the housing 10 is at the end of the cavity 5 exposed to the interior of the pipe section 2. The base 12 of the housing 10 is adjacent to the end of the cavity 5 which is exposed to the exterior of the pipe 2 and thus to the annulus between the drill string and the bore hole when the motor is connected to the drill string. The cavity 5 thus acts as a receptacle for the recorder unit. The open end of the cup is closed by closure plate 15 held in place by snap ring 16. The closure plate 15 and the base 12 carry bosses 17 and 18, which are bored to receive a piston 19 slideably positioned in the bosses. The piston carries a shoulder 20. A spring 27 is mounted between the shoulder 20 and the base 12. A plate 21 divides the interior of the housing 13 into a chambers 22 and 23. Switch contact 24 mounted in the divider 21 and switch contact 25 carried by the piston 19, both suitably insulated, make contact when the pressure at the bores of the boss 18 in the base 15 against the end of piston 19 exceeds the pressure exterior of the pipe 2 in the annulus 26 at the piston end in the bore of boss 17, in an amount greater than the spring bias of the spring 27, sufficient to move piston to close the contacts 24 and 25. Suitable 'O' ring seals are provided, as shown at 28, to insulate the interior of the housing 10 from pressures exterior of the housing.

Suitable batteries 29 (see FIG. 3) are mounted in chamber 22 and the recording unit 30 is mounted in chamber 22.

Figure 5:
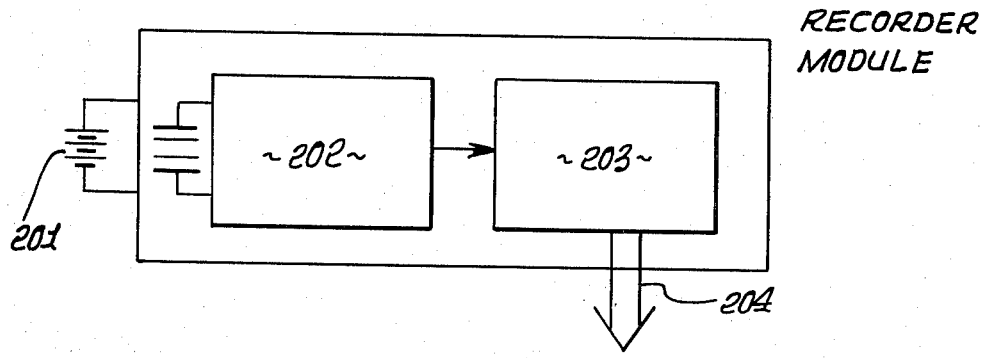
FIG. 5 is a schematic block diagram of a signal recorder positioned at the entrance to the in-hole motor.
Figure 6:
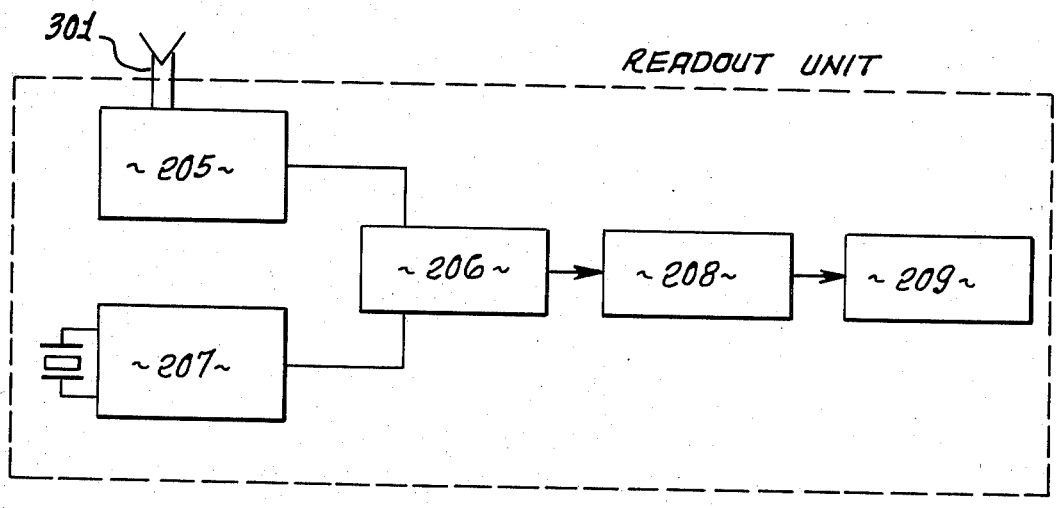
FIG. 6 is a schematic block diagram of a real time read-out device for use with the recorder of FIG. 5.

The schematic diagram, FIGS. 4 and 5, illustrate such recorders. FIG. 5 illustrates the recorder in our preferred embodiment whereby the time during which the switch contacts are closed is recorded. FIG. 6 is a schematic diagram of the decoding and read out circuit suitable for use to read and display the time recorded by the recording unit, such as is shown in FIG. 5.

The various circuit elements are of conventional design and are widely used for the circuit functions for which they are used in my invention.

The circuit elements represented by the block diagram are all conventional and are available as commercial articles as is well known to those skilled in the relevant art.

In FIG. 4, the battery 101 is connected to the digital clock 103 through the switch 102, for example, one such as is shown in FIGS. 1–3. The digital clock 103 which displays the real time interval during which the switch closes the battery circuit on the clock. The clock displays the real time in 24 hour days at 104, hours at 105 and minutes at 106 during which the switch is closed.

Such clocks are commonly available.

FIG. 5 illustrates the time recorder which is my presently preferred embodiment. Battery 201 is the battery positioned in chamber 23 of the pressure switch of Units A or B of FIGS. 2 and 3. It powers the crystal controlled oscillator 202 which delivers a square wave high frequency pulse. The signal is delivered to the counter 203. The counter counts the pulses delivered to the counter in the period of real time during which the switch is closed. The voltage applied by the counter at its several output legs forms a binary signal corresponding to the number of pulses in the period of real time during which the switch is closed. This signal is applied at the output 204 of the counter.

A decoder is provided to read the signal output at 204 and to translate the signal to the real time interval.

In FIG. 6, the terminal 301 is the input connection to the decoder, whereby the signal delivered at 204 may be applied to the buffered pick-up 205 and to the comparator 206. The oscillator 207 delivers square wave at the desired frequency and is applied to the comparator 206. The output of the comparator is converted in decoder 208 into a digital signal of the real time interval, for example, which may be displayed at 209, as hours and minutes which is the real time interval corresponding to the digital signal delivered to the buffered pick-up 205.

The above read out unit, FIG. 6, may be positioned at the surface at the well head or any other desired space.

In using the above recorder, the time recorder, as shown in FIG. 4 or 5, is mounted in the cavity 5. This may be done when the in-hole motor is assembled and before it is connected to the drill. By reference to FIG. 2, it will be seen that one end **19*a* of the piston 19 is exposed to the interior of the pipe 2 of the pipe section which forms part of the motor assembly prior to its connection to the drilling pipe string. The other end 19*b* of the piston 19 is exposed to the exterior of the pipe section 2**.

As shown in FIGS. 1 and 2, there are two such clock units positioned at diametrically positioned cavities 5 and 5'. Each unit is of same construction except for the magnitude of the spring bias of the springs as will be more fully described below.

When using the conventional clock of FIG. 4, the clock is preset, with the switch in open position to zero time in hours and minutes for any day of the week selected by the manual controls provided in such clocks.

When using the form of FIG. 5, the circuit with the switch open produces a zero output at 204.

The spring bias, when only one unit is used (for example Unit A, see FIG. 2), is set to be greater than the pressure differential across the ends 19*a* and 19*b* of the piston when the motor, connected as is conventional in a drilling string, is not operating in the drilling mode. The switch is open in such a condition, the dump valve, commonly used, is in the closed position as is any circulating valve, if used. The spring bias of spring 27 holds the switch in the open position.

The pressure difference between the pressure at 19*a* and 19*b* which must overcome the spring bias to close the switch in the drilling mode, is that occuring due to the flow of drilling fluid through the stator and the drill nozzles conventionally provided in bore hole drills. In practical terms, the spring bias is substantially the sum of the pressure drops across the stator of the motor and the pressure drop through the nozzles which are provided in the bits used in drilling when the motor is operating in the drilling mode.

In the non-drilling mode, as when the bit is suspended off bottom, or where a circulating valve is used in the string, the pressure differential across the ends of the piston 19 is substantially less than the pressure drop during drilling. For practical purposes, the pressure difference between 19*a* and 19*b* in the non-drilling mode is substantially less than in the drilling mode. The consequence of this arrangement is that the switch is receptical 5 is closed only during the period of time that the unit is in the drifting mode and in the case of the switch for the unit in receptical 5' for the non-drilling mode, the switch is closed only during the time interval during which the drill is suspended in the non-drilling mode above the bottom of the bore and circulation of the drilling fluid is maintained.

In Unit A (see FIG. 2) the spring bias is small enough to hold the switch in the closed position, when the pressure difference is that occuring during the drilling mode, it will open the switch when the pressure drop across the ends of the piston of Unit A is less than the bias of the spring 27.

The switch will close and activate the elapsed time recorders only when the pressure difference between 19*a* and 19*b* times the exposed areas against which the pressures are expected is greater than the spring bias due to flow of drilling fluid through the stator and bit nozzles and up the annulus of the bore hole. This pressure difference during drilling is greater than the pressure drop when circulation occurs with the bit held off bottom. The spring bias is set to be greater than the pressure drop in the non-drilling mode and less than in the drilling mode. The clock systems of System A are thus in the active mode only during periods of real time that the system is in the drilling mode.

The bias of the spring 27 in Unit B is substantially less than that of spring 27 of Unit A by degreee substantially the difference in pressure drop through the nozzles in the drilling mode as compared with the drop in the non-drilling mode. The switch of Unit B is closed and time is recorded with the motor in both the drilling mode and the non-drilling mode. The switch is closed during circulation through the stator both in the drilling and non-drilling modes.

Both switches are open when no circulation of drilling fluid passes through the stator. The clock employed in Unit A, whether it be of the form of FIG. 4 or FIGS. 5 and 6, will give a signal which is characteristic of the total time in which the motor was used in the drilling mode and Unit B will report the time of circulation in both the drilling and in the the non-drilling mode. The read out applied to the Unit B and to the Unit A, will give the time interval during which the above circulation occurs during the drilling mode and the non-drilling mode.

The difference in the times as recorded will be that during which circulation is maintained through the motor in the non-drilling modes.

It will be observed that with either the circulating valve or the dump valve open both switches will be in open position and the pressures across the piston are in substantial balance, and no time is recorded. The switches are in open position when the motor is not assembled with the bit and drill string as well as during assembly or disassembly of the drill string.

When the systems (FIG. 4 or FIGS. 5 and 6) are with the switches open and after the time record is observed, the systems of FIG. 4 and FIGS. 5 and 6 may be reset to zero time for further use.

I claim:

1. In combination with an in-hole motor, means responsive to the circulation of fluid to said motor, said means comprising: a time recorder adjacent the entrance to the motor, a power source to activate the time recorder and a switch positioned adjacent to said motor and electrically connected between said power source and said time recorder.

2. The in-hole motor of claim 1, in which said power source comprises a battery, and said switch is a pressure differential switch responsive to pressure in the interior and exterior of said pipe section.

3. The in-hole motor of claim 1 or 2, said switch biased to be open when the pressure difference between the exterior and interior of the pipe section is less than said bias.

4. An in-hole motor of claim 1 or 2, in which said time recorder is a clock.

5. An in-hole motor is claim 1 or 2, in which said time recorder includes an oscillator and a counter.

6. The in-hole motor of claim 1, in which said time recorder includes an oscillator and a counter and means to translate the output of said counter to a real time signal.

7. The in-hole motor of claim 2, in which said time recorder includes an oscillator and a counter and means to translate the output of said counter to a real time signal.

8. An in-hole motor comprising a pipe section connected to the inlet to said motor, a receptical in the wall of said pipe section, said receptical containing a battery and a biased pressure differential switch and a signal generator connected to said battery by said switch when the difference between pressure in the interior of said pipe section and the pressure at the exterior of said pipe is greater than said bias.

9. The motor of claim 8 in which the said signal generator is a clock.

10. The motor of claim 8, in which the signal generator is a time responsive voltage generator.

11. The motor of claim 8, in which the signal generator is an oscillator and counter generating a digital signal output responsive to the period of real time during which said switch connects said signal generator to said battery.

12. In combination with the motor of claim 11, a readout unit translating said digital output to real time.

* * * * *